US005579683A

United States Patent [19]

Hartmann

[11] Patent Number: 5,579,683

[45] Date of Patent: Dec. 3, 1996

[54] METHOD FOR SUPPLYING MATERIAL FOR PRESSING TO A FILTER PRESS

[75] Inventor: Eduard Hartmann, Schneisingen, Switzerland

[73] Assignee: Bucher-Guyer AG, Maschinenfabrik, Niederweningen, Switzerland

[21] Appl. No.: 553,416

[22] PCT Filed: Mar. 13, 1995

[86] PCT No.: PCT/CH95/00054

§ 371 Date: Nov. 22, 1995

§ 102(e) Date: Nov. 22, 1995

[87] PCT Pub. No.: WO95/26265

PCT Pub. Date: Oct. 5, 1995

[30] Foreign Application Priority Data

Mar. 25, 1994 [CH] Switzerland ..... 895/94

[51] Int. Cl.[6] ..... B30B 9/02

[52] U.S. Cl. ..... 100/37; 100/45; 100/50; 100/104; 426/231; 426/489

[58] Field of Search ..... 100/37, 43, 45, 100/50, 99, 104, 107, 125, 211; 99/486, 495; 426/231, 478, 489

[56] References Cited

U.S. PATENT DOCUMENTS

| | | | |
|---|---|---|---|
| 4,467,715 | 8/1984 | Bunger | 100/45 |
| 4,568,549 | 2/1986 | Melandri | 426/489 |
| 5,207,154 | 5/1993 | Bonnet | 100/37 |
| 5,275,740 | 1/1994 | Spyker et al. | 100/45 |

FOREIGN PATENT DOCUMENTS

| | | | |
|---|---|---|---|
| 0485901 | 5/1992 | European Pat. Off. . | |
| 2322002 | 2/1977 | France | 100/104 |
| 2411699 | 7/1979 | France . | |
| 1502180 | 8/1969 | Germany . | |
| 2057300 | 5/1972 | Germany . | |
| 2050597 | 5/1972 | Germany . | |
| 56-13011 | 2/1981 | Japan | 100/104 |
| 2016258 | 9/1979 | United Kingdom . | |
| 2059277 | 4/1981 | United Kingdom | 100/211 |

*Primary Examiner*—Stephen F. Gerrity
*Attorney, Agent, or Firm*—Burns, Doane, Swecker & Mathis, LLP

[57] ABSTRACT

In supplying material for pressing (37) into the press chamber of a filter press for separating solids and liquids, the filling operation (F) is done interruptedly in a first step (P1) at a fill opening (44). A press element (36) executes a plurality of pressings up to a constant stroke position (HS). Not until a second method step (P2) is the filling operation (F) interrupted, as soon as the pressing pressure exceeds a limit value (PS), whereupon the pressings are continued with shortened strokes. The method offers automatic adaptation of the prefilling time to the pressability of the materials. It thus becomes possible to prefill highly differently pressable material automatically and without specifying a command value in such a way that an optimal performance is attained in terms of the yield and the juice extraction output of a filter press.

9 Claims, 3 Drawing Sheets

METHOD FOR SUPPLYING MATERIAL FOR PRESSING TO A FILTER PRESS

FIELD OF THE INVENTION

The invention relates to a method for supplying material for pressing to a filter press having a press chamber for separating solids and liquids in the material for pressing; the material for pressing is supplied to the press chamber and there is pressed out under the influence of a press element acted upon by compressive force.

BACKGROUND OF THE INVENTION

In discontinuous filter presses of this kind, the liquid component of the material for pressing is carried to the outside via filter, under the influence of a pressing pressure. The pressing pressure is exerted upon the material for pressing directly via a rigid pressure plate, or pneumatically or hydraulically via a flexible diaphragm. At the onset of supply of the material for pressing, the question arises as to what amount must be prefilled in the press chamber so that an adequate pressing cushion will be available for the first pressing. Care must be taken that with the pressure plate or diaphragm extended, the ratio between the effective filter surface area and the instantaneous press chamber volume is higher than with the press element retracted.

The press is overfilled if the ratio between the effective surface area and the instantaneous press chamber volume becomes too small as a consequence of an overly large pressing cushion, the result being worsening of the juice extraction output. In known pressing methods, the material for pressing was supplied in such a way that filling is done during a constant prefilling time chosen on the basis of empirical values. Experience has taught that for materials that are difficult to press, only a fraction of the time appropriate for readily pressed material is needed as the prefilling time. Particularly when fruit is pressed, it proves to be very difficult to ascertain an optimal prefilling time, because the pressability of the materials fluctuates very sharply from one batch to another.

SUMMARY OF THE INVENTION

It is therefore the object of the invention to disclose a method for supplying material for pressing to a filter press which produces an optimal output and yield in the separation of liquids and solids.

According to this invention, this object is attained in that in a first step, the material for pressing is supplied uninterruptedly to the press chamber, and at the same time by means of pressing strokes of the press element, a plurality of pressings are performed, and that in a second step, the pressings are continued, and the supply of material for pressing to the press chamber is interrupted during the pressings.

Advantageous embodiments of the method can be learned from the claims.

BRIEF DESCRIPTION OF THE DRAWINGS

Exemplary embodiments of the invention are described in further detail in the ensuing description and in the drawing figures. Shown are.

DESCRIPTION OF THE PREFERRED EMBODIMENTS

Figure 1:
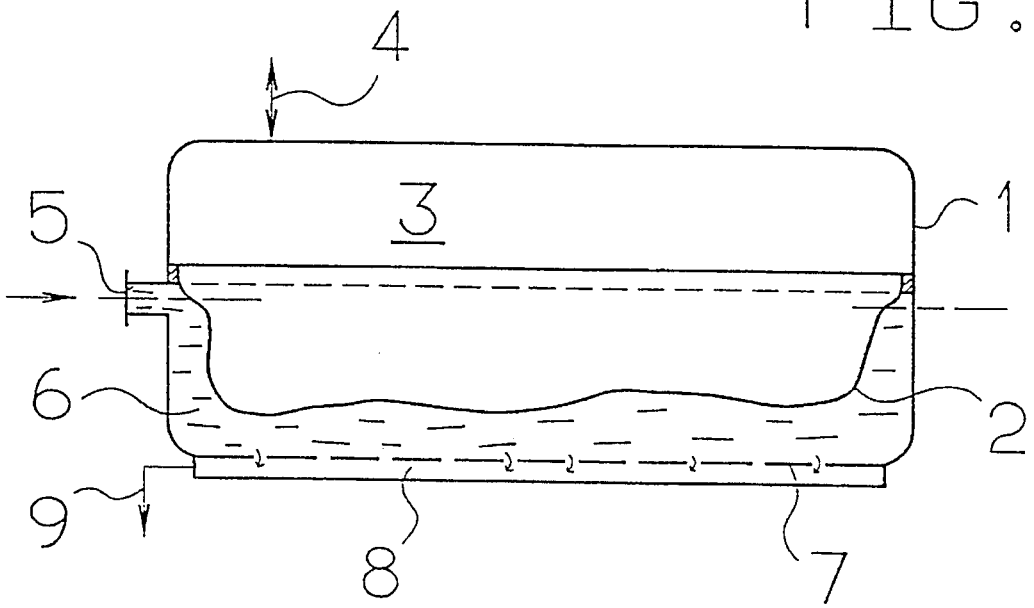
FIG. 1, a section through a pneumatically driven press of a known kind.

A pneumatically driven press of a known kind for performing the method of the invention is shown in FIG. 1. It has an elongated cylindrical pressing tank 1, inside which in whose central plane a flexible diaphragm 2 is secured. The diaphragm 2 divides the pressing tank 1 longitudinally into a pressure chamber 3 and a press chamber 6. The pressure chamber 3 is supplied with or drained of compressed air via an opening symbolically represented by a double arrow 4. The material to be pressed is supplied to the press chamber 6 via an opening 5. Under the influence of the compressed air in the pressure chamber 3 upon the diaphragm 2, the liquid component of the material for pressing flows via a filter 7 in the press tank 1 into a collecting conduit 8, from which it is removed to the outside via a line 9. To carry out the supplying of the material for pressing according to the invention, in a first step the material for pressing is supplied uninterruptedly to the opening 5 of the press chamber 6, and by means of pressing strokes of the diaphragm 2, a plurality of pressings are simultaneously performed.

Figure 2:
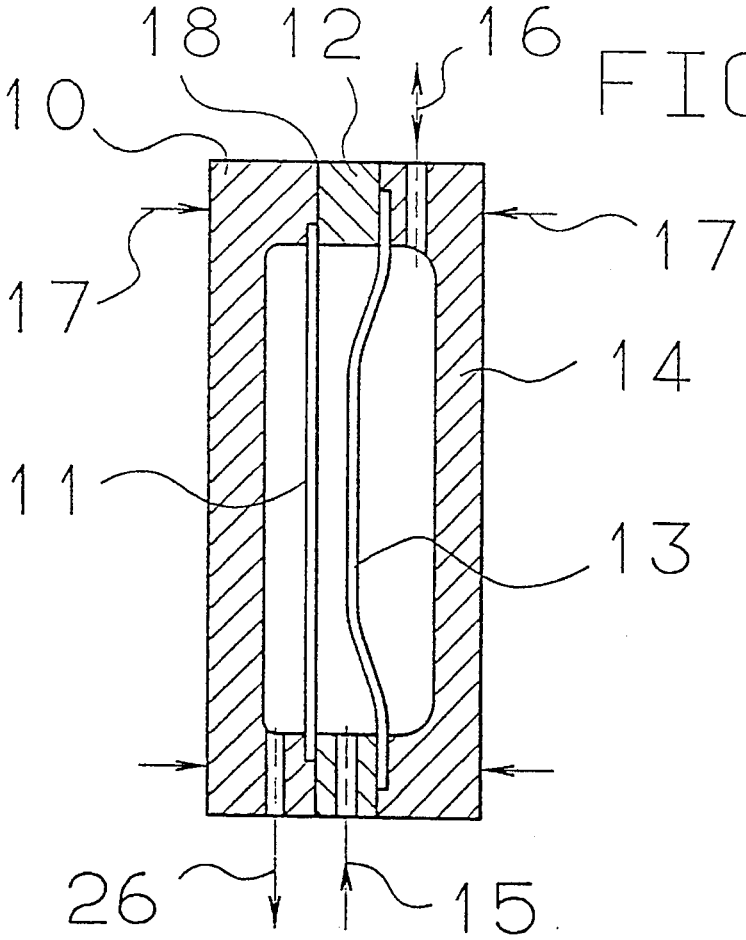
FIG. 2, a section through a chamber filter press of a known kind.

FIG. 2 shows a chamber filter press of a known kind in section. Above the chamber bottom 10 as a carrier, a filter 11 is mounted spaced apart from it, and opposite it is a pressure diaphragm 13, spaced apart from it by an intermediate frame 12 and fixed by a chamber lid 14 acting as a carrier. The supply of the material for pressing is effected continuously via an opening 15 in the intermediate frame 12; under the influence of compressed air supplied or removed via an opening 16 in the chamber lid 14, a plurality of pressings are made simultaneously by means of pressing strokes of the pressure diaphragm 13. The liquid component of the material for pressing, pressed out in this process, is removed to the outside via an opening 26 in the chamber bottom 10. The unit described thus far of the chamber filter press is held together by clamping forces exerted from outside and symbolically represented by the arrows 17. For an operation of removing the residues from the pressing, a separation is effected between the chamber bottom 10 and the intermediate frame 12, at the point marked 18, once the clamping forces 17 have been reduced.

Figure 3:
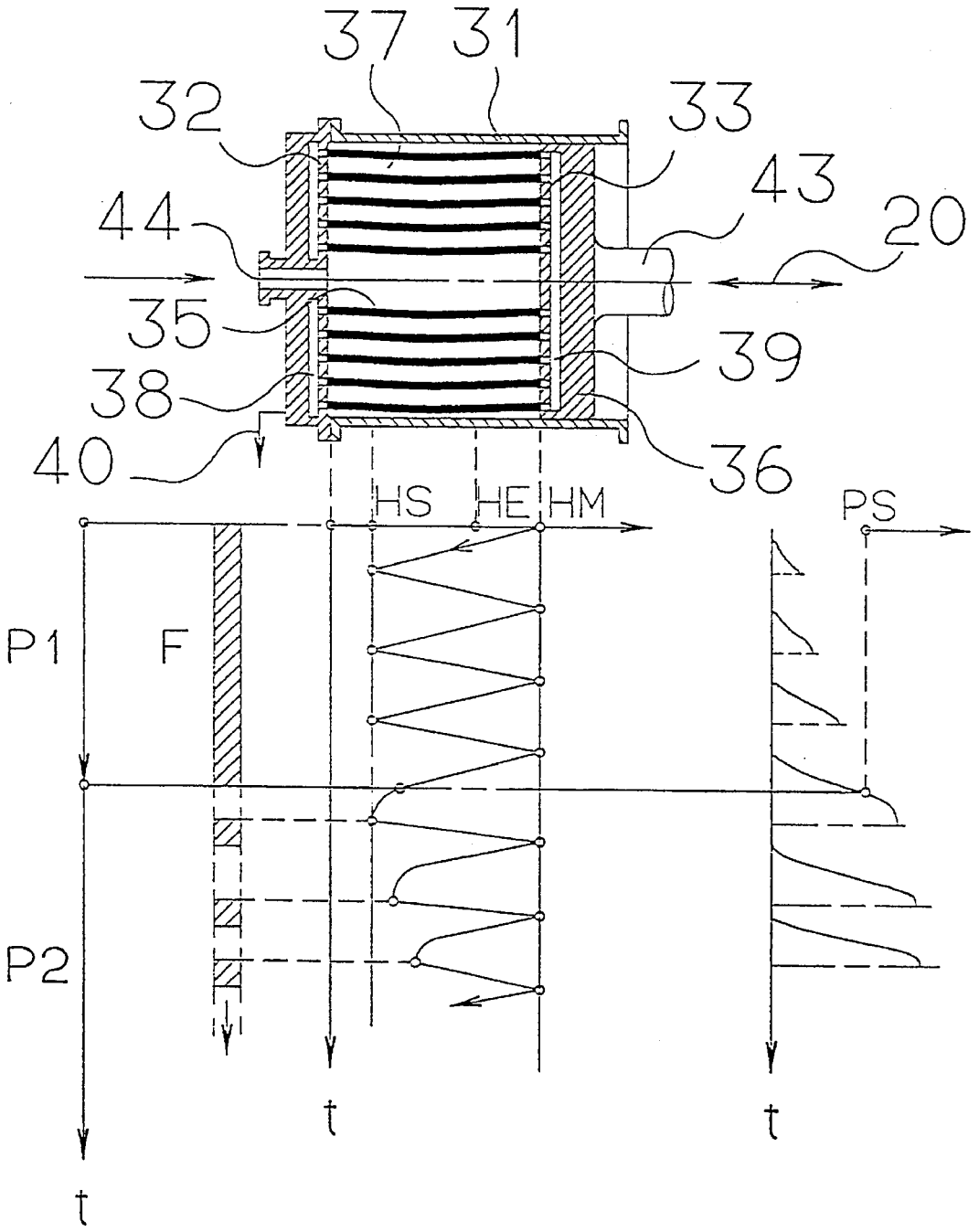
FIG. 3, a section through a filter press with a pressing piston, along with a graph showing the course over time of piston strokes, pressing pressure and supply of the material for pressing.

FIG. 3 schematically shows a horizontal filter piston press of a known kind. It includes a pressing jacket 31, which is detachably connected to a pressure plate 32. Opposite the pressure plate 32 inside the pressing jacket 31 is the second pressure plate 33, which is secured via a pressing piston 36 to a piston rod 43. The piston rod 43 is movably supported in a hydraulic cylinder, as indicated by the arrow 20, and it executes the pressing operations via the pressing piston 36. The material for pressing 37 is introduced between the pressure plates 32 and 33 via a closable fill opening 44, and a number of drainage elements 35 extends through the material for pressing.

In the pressing operation, the drainage elements 35 carry the liquid phase of the material for pressing 37 into collecting chambers 38 and 39, which are disposed behind the pressure plates 32 and 33. The material for pressing may be fruit, and hence the liquid phase may be fruit juice. When pressure is exerted by the pressing piston 36, the liquid phase passes out of the material for pressing 37 to the outside, via the collecting chambers 38, 39, in discharge lines 40. The pressing pressure is generated in the hydraulic cylinder, and a nonpositive connection, not shown, exists between the front pressure plate 32 and the pressing jacket 31, on the one hand, and the cylinder on the other. Once the pressing operation has been completed, the emptying of the press is done by releasing the pressing jacket 31 from the pressure plate 32 and axially displacing it.

The known course of the pressing process in the normal situation is as follows:

Filling operation:

the pressing jacket 31 is closed with the pressure plate 32;

the pressing piston 36 is retracted;

the material for pressing 37 is introduced via the opening 44.

Pressing operation:

The entire press unit shown in FIG. 3 is rotated about the center axis;

the pressing piston 36 is extended under pressure;

the juice is separated from the material for pressing by pressing;

the pressing pressure is switched off.

Loosening operation:

the pressing piston 36 is retracted, in the course of the rotation of the entire pressing unit shown in FIG. 3; the material for pressing that has remained behind is loosened and broken up.

Further pressing operation:

the method steps of pressing and loosening are repeated multiple times in the form of pressing per batch of material for pressing, until a desired pressed-out state is attained.

Emptying operation:

the pressing residues are removed from the pressure plate 32 by opening the pressing jacket 31.

The course of the method according to the invention in a filter piston press will now be described in detail, referring to FIG. 3. This drawing, in addition to the already-described illustration of the filter piston press, includes associated graphs that, for the two steps P1 and P2 according to the invention, show the piston strokes between the positions HM and HS, the corresponding course of the pressing pressure with a limit value PS, and the filling function F over the time t. As shown by the time diagrams next to the pressing jacket 31, at the beginning, by means of a command "START FILLING", the material for pressing 37 is supplied continuously by means of a pump to the press chamber via the opening 44. In this operation, the pressure plate 33, beginning at a position HM, is moved in the direction of the arrow 20 toward the opening 44, and upon reaching the position HS is immediately retracted back to its outset position HM.

During the first step, marked P1, this operation is repeated until such time, in the extension motion of the pressure plate 33, as the pressing pressure in the material 37 that has been introduced rises to a predetermined value PS, as shown in the time diagram for the pressing pressure. A bar marked F shows the continuous filling operation that takes place at the same time.

Once the command pressure PS is reached, the prefilling and hence step P1 of the filling operation are ended. After that time, in a second step marked P2, filling is now done only in discontinuous phases, each beginning with the retraction of the pressure plate 33. Although not shown in detail in the diagram, it can be expedient to generate a negative pressure in the press chamber, by retraction of the pressure plate 33, that has a cleaning action on the filter located on the drainage elements 35. The position HS is equivalent to a constant stroke position of the pressure plate 33 and thus to a press volume reduced to a constant value. This has the advantage that at the repeatedly reached stroke position HS, according to the invention a favorable ratio for the pressing operation between the filter surface area of the drainage elements 35 and the quantity of the introduced material for pressing 37 prevails in the press.

In a variant of the method, not shown in FIG. 3, the extension of the pressure plate 33 to the constant position HS is omitted. Instead, in a first step P1, on each pressing the extension is done only to such a point that the pressure in the material for pressing reaches a level below or equal to the supply pressure of the material for pressing in the filling operation F. As the filling of the press chamber progresses, the pressure plate 33 then reaches positions that are farther and farther away from HS. In this case, the continuous filling operation F is interrupted if a limit position HE is reached, whereupon the second method step P2 begins.

In a further variant of the method, it may prove advantageous with a view to the pressability of the material for pressing to reduce the supplied force at the press element in the course of the first step once the limit value for the pressing stroke or pressing pressure is reached, until the pressing pressure drops to a value below the supply pressure of the material for pressing. The pressing pressure is thereafter kept virtually constant at this value, over a predetermined period of time, before the retraction of the pressing element is initiated.

Figure 4:
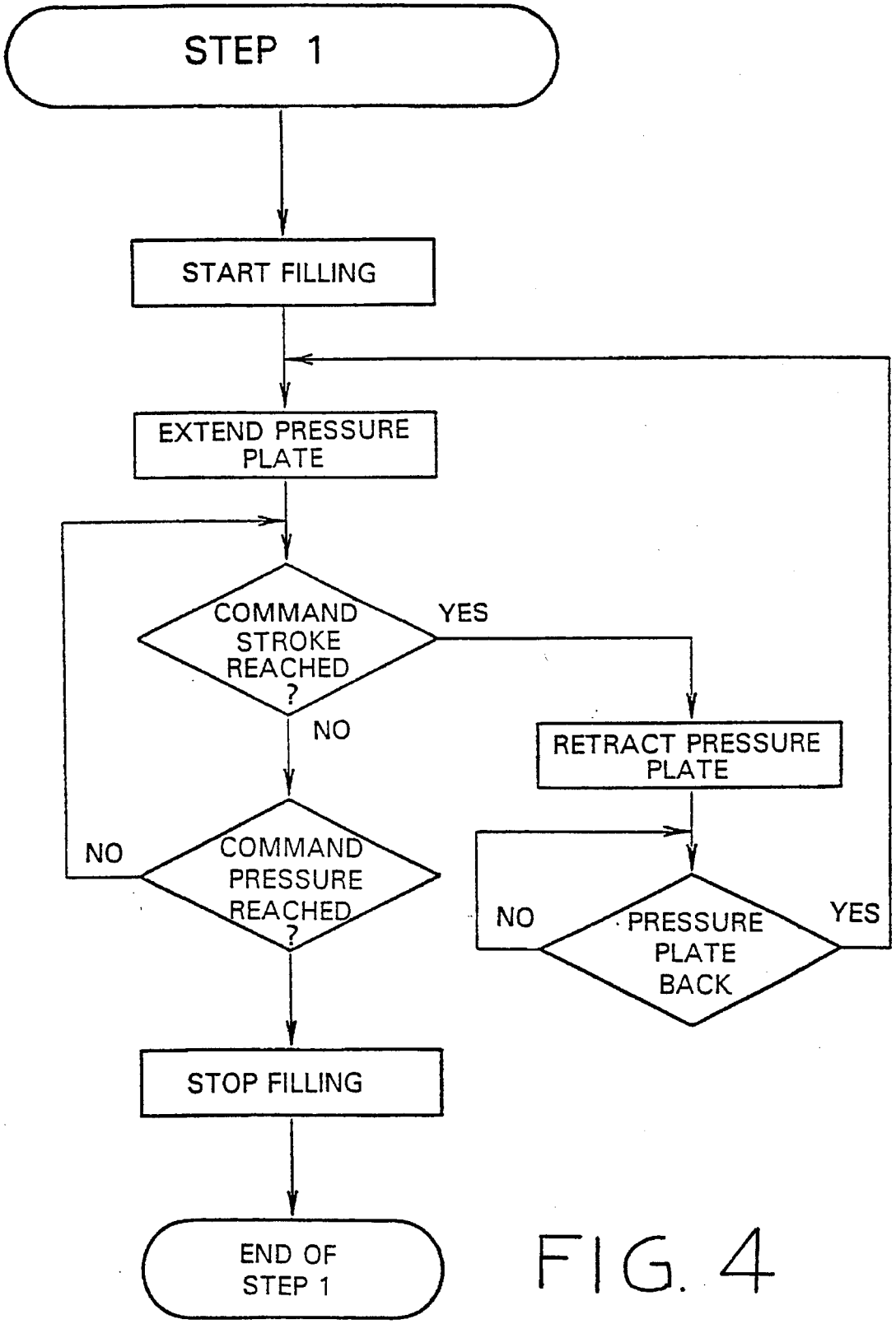
FIG. 4, a flowchart for a first step of the filling method according to the invention.

FIG. 4, as a summary of the supply method described in conjunction with FIG. 3, shows a flow chart for the first step P1. In the pressings with the pressing strokes of the pressure plate 33 up to the constant position HS, the loop having the following elements is run through: "EXTEND PRESSURE PLATE"—"COMMAND STROKE HS REACHED?"—"COMMAND PRESSURE PS REACHED?", or "RETRACT PRESSURE PLATE"—"PRESSURE PLATE BACK?"—"EXTEND PRESSURE PLATE". Once the command pressure PS is reached, then the command "STOP FILLING" and "END OF STEP 1" take place.

The method described thus far for supplying material for pressing, having the two steps according to the invention, offers automatic adaptation of the prefilling time to the pressability of the material. In the first step, only just enough material for pressing is introduced as is needed to generate an adequate pressing cushion. At the same time, overfilling of the press is avoided. It thus becomes possible, automatically and without specifying a command value, to prefill material that is highly differently pressable in such a way that an optimal performance is attained in terms of the yield and the juice extraction output of a filter press.

What is claimed is:

1. A method for supplying material for pressing (37) to a filter press having a press chamber (6) for separating solids and liquids in the material for pressing, wherein the material for pressing is supplied to the press chamber (6) and there is pressed out under the influence of a press element (2, 13, 33) acted upon by compressive force, characterized in that in a first step (P1), the material for pressing (37) is supplied uninterruptedly to the press chamber (6), and at the same time by means of pressing strokes of the press element (2, 13, 33), a plurality of pressings are performed, and that in a second step (P2), the pressings are continued, with the supply of material for pressing (37) to the press chamber being interrupted during the pressings.

2. The method of claim 1, characterized in that the beginning of the second step (P2) is effected by an interruption in the supply of material for pressing (37) to the press chamber (6), as soon as a predetermined limit pressure value (PS) is attained in a pressing operation in the press chamber.

3. The method of claim 1, characterized in that in the first step (P1), the pressing strokes are selected, by extension of the press element (2, 13, 33) in the pressings, such that the pressing pressure in the material for pressing (37) rises only up to a limit value, which is below the supply pressure for the material for pressing (37), and that after the extensions have been executed, a negative pressure is generated in the press chamber by retraction of the press element (2, 13, 33).

4. The method of claim 3, characterized in that the beginning of the second step (P2) is effected by an interruption in the supply of the material for pressing (37) to the press chamber (6), as soon as the press element (2, 13, 33) in a pressing operation attains a predetermined minimal pressing stroke (HE) in the press chamber (6).

5. The method of claim 3, characterized in that in the first step after the attainment of the limit value of the pressing pressure, the compressive force introduced to the press element (2, 13, 33) is reduced, until the pressing pressure drops below the supply pressure for the material for pressing (37), and that this pressing pressure is then kept virtually constant over a predetermined period of time before the retraction of the press element is initiated.

6. The method of claim 1, characterized in that in the second step (P2), the supply of the material for pressing (37) to the press chamber (6) is interrupted once the pressing pressure in the press chamber rises.

7. The method of claim 1, characterized in that in the first step (P1), the pressing strokes are selected, by extension of the press element (2, 13, 33) in the pressings, such that the press chamber volume decreases only down to a limit value (HS), and that after the limit value (HS) is reached, the retraction of the press element is initiated.

8. The method of claim 7, characterized in that the attainment of the limit value (HS) of the press chamber volume is ascertained, in the case where the filter press is a piston press, by sampling of a command value of the piston stroke.

9. The method of claim 7, characterized in that in the first step after the attainment of the limit value (HS) of the press chamber volume, the compressive force introduced to the press element (2, 13, 33) is reduced, until the pressing pressure drops below the supply pressure for the material for pressing (37), and that this pressing pressure is then kept virtually constant over a predetermined period of time before the retraction of the press element is initiated.

* * * * *